US007933768B2

(12) United States Patent
Kikumoto

(10) Patent No.: US 7,933,768 B2
(45) Date of Patent: Apr. 26, 2011

(54) VOCODER SYSTEM AND METHOD FOR VOCAL SOUND SYNTHESIS

(75) Inventor: Tadao Kikumoto, Imaga-Gun (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 1207 days.

(21) Appl. No.: 10/806,662

(22) Filed: Mar. 23, 2004

(65) Prior Publication Data

US 2004/0260544 A1 Dec. 23, 2004

(30) Foreign Application Priority Data

Mar. 24, 2003 (JP) ..... 2003-080246

(51) Int. Cl.

| | |
|---|---|
| ***G10L 19/14*** | (2006.01) |
| ***G10L 11/04*** | (2006.01) |
| ***G10L 19/06*** | (2006.01) |
| ***G10L 21/00*** | (2006.01) |

(52) U.S. Cl. ..... 704/209; 704/205; 704/206; 704/207; 704/278

(58) Field of Classification Search ..... 704/205–207, 704/209, 278

See application file for complete search history.

(56) References Cited

U.S. PATENT DOCUMENTS

| | | | | | |
|---|---|---|---|---|---|
| 3,711,620 | A | * | 1/1973 | Kameoka et al. | 84/706 |
| 4,192,210 | A | * | 3/1980 | Deutsch | 84/622 |
| 4,300,434 | A | * | 11/1981 | Deutsch | 84/608 |
| 4,311,877 | A | * | 1/1982 | Kahn | 704/205 |
| 4,374,304 | A | * | 2/1983 | Flanagan | 704/206 |
| 4,406,204 | A | * | 9/1983 | Katoh | 84/119 |
| 5,109,417 | A | * | 4/1992 | Fielder et al. | 704/205 |
| 5,231,671 | A | | 7/1993 | Gibson et al. | |
| 5,301,259 | A | | 4/1994 | Gibson et al. | |
| 5,401,897 | A | | 3/1995 | Depalle et al. | |
| 5,567,901 | A | | 10/1996 | Gibson et al. | |
| 5,641,926 | A | | 6/1997 | Gibson et al. | |
| 5,691,496 | A | * | 11/1997 | Suzuki et al. | 84/661 |
| 5,945,932 | A | * | 8/1999 | Smith et al. | 341/51 |
| 5,981,859 | A | * | 11/1999 | Suzuki | 84/601 |
| 5,986,198 | A | | 11/1999 | Gibson et al. | |

(Continued)

FOREIGN PATENT DOCUMENTS

| | | |
|---|---|---|
| JP | 5-2390 | 1/1993 |
| JP | 2001-154674 | 6/2001 |

OTHER PUBLICATIONS

Pedro Cano, Alex Loscos, Jordi Bonada, Maarten de Boer, Xavier Serra, "Voice Morphing System for Impersonating in Karaoke Applications", ICMC 2000.*

(Continued)

*Primary Examiner* — Eric Yen
(74) *Attorney, Agent, or Firm* — Foley & Lardner LLP

(57) ABSTRACT

A vocoder system for improving the performance expression of an output sound while lightening the computational load. The system includes formant detection means and division means in which the center frequencies have been fixed. The modulation level with which the levels of each of the frequency bands that have been divided in the division means are set by a setting means based on the levels of each of the frequency bands that correspond to those that have been detected in the formant detection means and formant information with which the formants are changed. Therefore, it is possible to improve the performance expression of the output sound with a light computational load and without the need to calculate and change the filter figure of each filter for each sample in order to change the center frequency and bandwidth of each of the filters comprising the division means.

52 Claims, 10 Drawing Sheets

U.S. PATENT DOCUMENTS

| | | | | |
|---|---|---|---|---|
| 6,046,395 | A | 4/2000 | Gibson et al. | |
| 6,098,038 | A * | 8/2000 | Hermansky et al. | 704/226 |
| 6,159,014 | A * | 12/2000 | Jenkins et al. | 434/169 |
| 6,182,042 | B1 * | 1/2001 | Peevers | 704/269 |
| 6,201,175 | B1 * | 3/2001 | Kikumoto et al. | 84/605 |
| 6,313,388 | B1 * | 11/2001 | Suzuki | 84/622 |
| 6,323,797 | B1 * | 11/2001 | Kikumoto et al. | 341/144 |
| 6,336,092 | B1 * | 1/2002 | Gibson et al. | 704/268 |
| 6,338,037 | B1 * | 1/2002 | Todd et al. | 704/500 |
| 6,362,411 | B1 * | 3/2002 | Suzuki et al. | 84/626 |
| 7,003,120 | B1 * | 2/2006 | Smith et al. | 381/61 |
| 7,152,032 | B2 * | 12/2006 | Suzuki et al. | 704/262 |
| 7,313,519 | B2 * | 12/2007 | Crockett | 704/226 |
| 7,343,281 | B2 * | 3/2008 | Breebaart et al. | 704/205 |
| 2002/0154041 | A1 * | 10/2002 | Suzuki et al. | 341/51 |
| 2003/0014246 | A1 * | 1/2003 | Choi | 704/207 |

OTHER PUBLICATIONS

Voice Quality Conversion in TD-Psola Speech Synthesis—Xuejing Sung—Speech Acoustics Laboratory, Department of Communication Sciences and Disorders—Northwestern University, Evanstan, IL 60208, USA—pp. 1-4.

Synthesizing a choir in real-time using Pitch Synchronous Overlap Add (PSOLA)—Norbert Schnell, Geoffroy Peeters, Serge Lemouton, Philippe Manoury, Xavier Rodet—IRCAM—Centre Georges-Pompidou—1,pl. Igor Stravinsky, F-75004 Paris France—www.ircam.fr—7 pages.

Web-SLS—The European Student Journal of Language and Speech—"A New Approach to the Evaluation of Vocal Effort by the PSOLA Method"—A. Tassa and J.S. Lienard—16 pages.

Data Sheet—VoiceWorks—Vocals on Target?—TC Helicon—Vocal Technologies—www.tc-helicon.com.

Data Sheet—Quintet—Vocals on Target?—TC Helicon—Vocal Technologies—www.tc-helicon.com.

Brochure—Powercore Rackmount Quality Processing Solution for MAC and PC—Edition Jan. 2003—TC Works—Ultimate Software Machines.

Brochure—Voice your Inspiration—Native Instruments Software Synthesis—Vokator—Voice your Inspiration—www.native-instruments.com.

* cited by examiner

VOCODER SYSTEM AND METHOD FOR VOCAL SOUND SYNTHESIS

BACKGROUND

1. Field of the Invention

The present invention relates to a vocoder system and, in particular, to a vocoder system and method for vocal sound synthesis, with which it is possible to improve the performance expression of a sound with a light computational load.

2. Description of the Prior Art

Vocoder systems have been known with which the formant characteristics of a speech signal that is input are detected and employed. Using a musical tone signal produced by operating a keyboard or the like, the musical tone signal is modulated by the speech signal, outputting a distinctive musical tone. With this vocoder system, the speech signal that is input is divided into a plurality of frequency bands by the analysis filter banks, and the levels of each of the frequencies that express the formant characteristics of the speech signal that are output from the analysis filter banks are detected. On the other hand, the musical tone signal that is produced by the keyboard and the like is divided into a plurality of frequency bands by the synthesis filter banks. Then, by amplitude modulation with the envelope curves that correspond to the output of the analysis filter banks, an effect such as that discussed above is applied to the output sound.

However, with the vocoder systems of the past, since the characteristics of each of the filters (the center frequency and bandwidth) of the analysis filter bank and the synthesis filter bank have been set to be equal, the formant characteristics of the speech signal are reflected as they are, unchanged, in the output sound. Thus, it has not been possible to change the formant of the speech that has been input and modulate the output of the synthesis filters. In other words, with the vocoder systems of the past, there is the problem that it is not possible to apply sound changes to the output sound using the sex, age, singing method, special effects, pitch information, strength, and the like. The performance expression of the output sound is, therefore, limited.

To solve this problem, there is a method in which the center frequencies of each of the filters that comprise the synthesis filter bank are changed with respect to the center frequencies of each of the filters that comprise the analysis filter bank. By means of this method, the formant characteristics of the speech signal can be shifted on the frequency axis and changed. It is thus possible to improve the performance expression of the output sound. It is set up, for example, with the speech signal divided into a plurality of frequency bands by the analysis filter bank and, in a specified time t, as is shown in FIG. 7(*a*), a formant curve in which the low range side is rich is detected. In this case, when the center frequencies of each of the filters that comprise the synthesis filter bank are changed so as to become a specified percentage higher than the center frequencies of each of the corresponding filters that comprise the analysis filter bank, the formant characteristics of the output sound that corresponds to FIG. 7(*a*) are changed, as is shown in FIG. 7(*b*), so as to be drawn toward the high frequency side on the frequency axis. Therefore, the formant characteristics of the male voices, which are rich on the low range side, can be shifted to the high range side and changed to the formants of female or children's voices.

On the other hand, in those cases where, contrary to what has been discussed above, the formant curve that is produced from the output from the analysis filter bank is, as is shown in FIG. 9(*a*), rich on the high range side, when the center frequencies of each of the filters on the synthesis side are changed so as to become a specified percentage lower than the center frequencies of each of the corresponding filters on the analysis side, the formant characteristics of the output sound that corresponds to FIG. 9(*a*) are changed, as is shown in FIG. 9(*b*), so as to be drawn toward the low frequency side on the frequency axis. Therefore, the formants of female voices, which have formant characteristics that are rich on the high range side, can be shifted to the low range side and changed to the formants of male voices.

If the center frequencies of each of the filters that comprise the synthesis filter bank are changed in this manner with respect to the center frequencies of each of the corresponding filters that comprise the analysis filter bank, it is possible for the formant characteristics of the speech signal to be changed and for this to be reflected in the output signal, and the performance expression of the output signal can be improved. In Japanese Unexamined Patent Application Publication (Kokai) Number 2001-154674, a vocoder system is disclosed that is related to this method in which the frequency band characteristics (the center frequencies) of the synthesis filter bank are changed appropriately and that has been furnished with a parameter setting means in which parameters are set in order to determine the frequency band characteristics of the synthesis filter bank.

However, in those cases where the method discussed above is employed in order to improve the performance expression of the output sound, the filter coefficients of each of the filters that comprise the synthesis filter bank must be changed. When this is carried out with digital filters, the computational load that is borne by the processing unit for the computation becomes great. In addition, since the synthesis filter bank is actually on the side on which the output sound is produced, in order to prevent the generation of noise, it is necessary to change the filter coefficients for each sample and do the computation; thus, the computational load on the processing unit becomes even greater.

In addition, in those cases where the method discussed above is employed when the formant characteristics are changed during the performance, it is necessary to change the filter coefficients of each of the filters that comprise the synthesis filter bank individually and continuously. Therefore, the computations of the processing unit become complicated and the computational load becomes great.

The present invention resolves these problems and has as its object a vocoder system with which it is possible to improve the performance expression of the output sound with a light computational load.

SUMMARY

In accordance with the vocoder system of the present invention, the system comprises formant detection means as well as division means in which the center frequencies are fixed and the modulation levels, which modulate the levels of each of the frequency bands that have been divided in the division means, are set by the setting means based on the levels of each of the frequency bands that correspond to what has been detected in the formant detection means and the formant information that changes the formants. Therefore, the invention has the advantageous result that it is possible to improve the performance expression of the output sound with a light computational load and without the need, as in the past to calculate and change the filter figure of each filter for each sample in order to change the center frequency and bandwidth of each of the filters that comprise the division means.

In order to achieve this object, the vocoder system is furnished with formant detection means with which the formant characteristics of the first musical tone signal are detected, and musical tone signal input means with which the second musical tone signal that corresponds to specified pitch information is input, and division means with which the second musical tone signal that is input in the musical tone signal input means is divided into a plurality of frequency bands, the respective center frequencies of which have been fixed, and setting means with which the modulation levels that correspond to each of the frequency bands that have been divided in the previously mentioned division means are set based on the previously mentioned formant characteristics that have been detected in the previously mentioned formant detection means and the formant control information with which the formant characteristics that are detected by the previously mentioned formant detection means are changed, and modulation means with which level of the signal of each of the frequency bands that have been divided in the previously mentioned division means is modulated based on the modulation level that has been set in the setting means.

The formant characteristics for the first musical tone signal are detected by the formant detection means. On the other hand, the second musical tone signal is input from the musical tone signal input means as the musical tone that corresponds to the specified pitch information and is divided into a plurality of frequency bands by the division means. The setting means sets the modulation level that corresponds to each of the frequency bands that have been divided in the division means based on the formant characteristics that have been detected in the formant detection means and the formant information with which the formant characteristics that have been detected in the formant detection means are changed. In addition, the levels that correspond to each of the frequency bands that have been divided in the division means are modulated by the modulation means based on the modulation levels that have been set.

The formant detection means may comprise a filter or a Fourier transform.

The division means may comprise a filter. The division means may comprise a Fourier transform.

The setting means sets the modulation level that corresponds to each of the frequency bands that have been divided in the division means based on the pitch information and the formant characteristics that have been detected in the formant detection means and the formant control information with which the formant characteristics that have been detected in the formant detection means are changed.

The setting means stores a formant change table that changes the formant non-uniformly and sets the modulation levels that correspond to each of the frequency bands that have been divided in the division means based on the change table.

BRIEF DESCRIPTION OF THE DRAWINGS

A detailed description of embodiments of the invention will be made with reference to the accompanying drawings, wherein like numerals designate corresponding parts in the several figures.

FIG. 7(*b*) shows a formant curve that is produced when the formant curve shown in FIG. 7(*a*) is changed;

FIG. 7(*c*) is a sinc function;

FIG. 7(*d*) shows each of the levels of the formant curve shown in FIG. 7(*a*) that has become a formant curve changed in the same manner as in FIG. 7(*b*);

FIG. 9(*b*) shows a formant curve that is produced when the formant curve shown in FIG. 9(*a*) is changed according to the prior art;

FIG. 9(*c*) shows each of the levels of the formant curve shown in FIG. 9(*a*) that has become a formant curve changed in the same manner as in FIG. 9(*b*)

DETAILED DESCRIPTION

Figure 1:
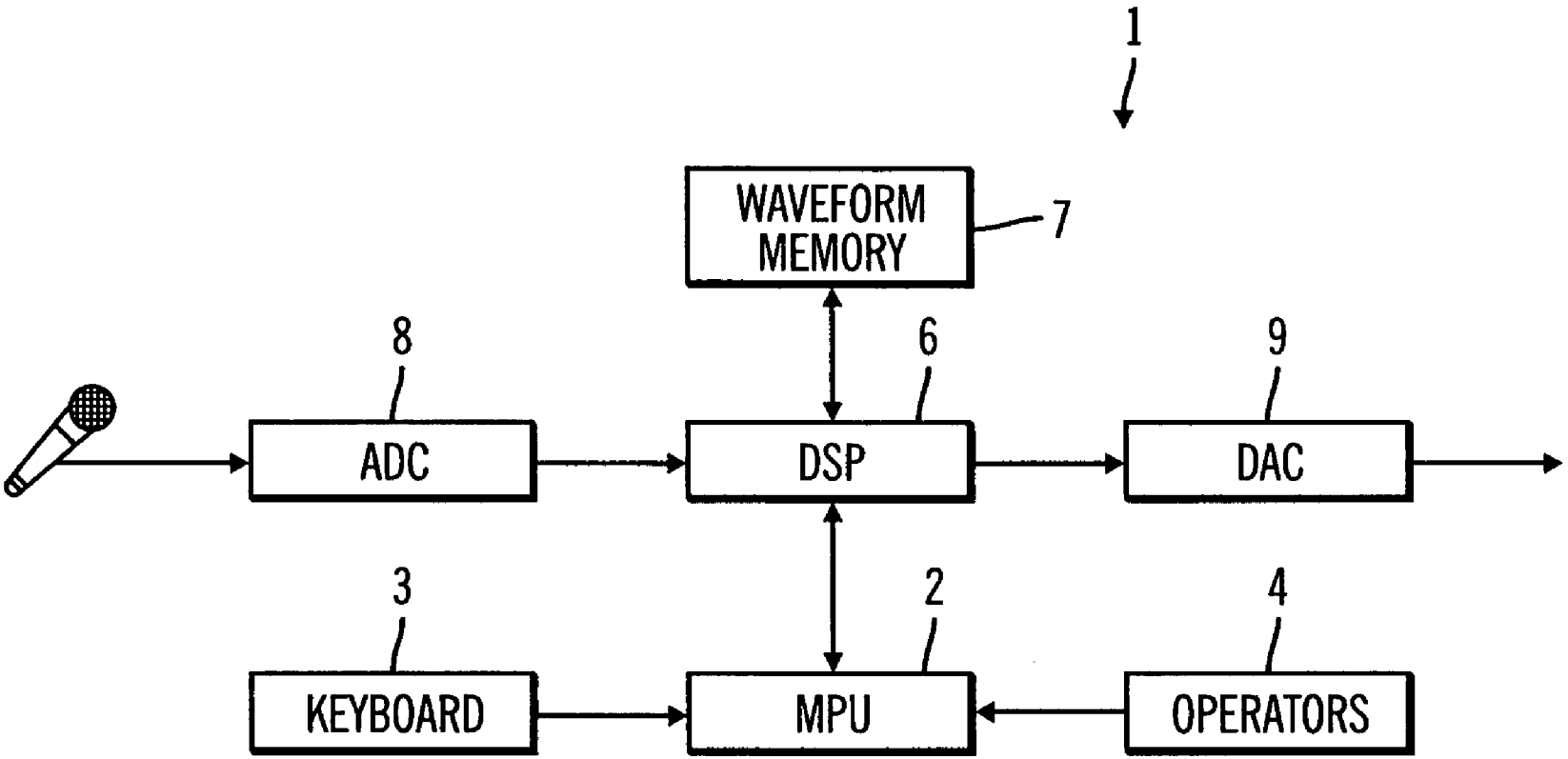
FIG. 1 is a block diagram that shows the electrical configuration of the vocoder system according to an embodiment of the present invention.

In the following description of preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the preferred embodiments of the present invention FIG. 1 is a block diagram that shows the electrical configuration of the vocoder system 1 in a preferred embodiment of the present invention. In the vocoder system 1, the MPU 2, the keyboard 3, which instructs the production of the musical tones, the operators 4, which include operators that instruct timbre selection and formant changes, an output level volume control, and the like, and the DSP 6 are connected through a bus line.

The MPU 2 is the central processing unit that controls this entire system 1 and has built in a ROM, in which are stored the various types of control programs that are executed by the MPU 2, and a RAM for the execution of the various types of control programs that are stored in the ROM and in which various types of data are stored temporarily The DSP 6 detects the formants by deriving the levels of each of bands of the speech signal that have been digitally converted. The DSP changes the formants of the input speech signals based on the formant control information that is instructed by the operators 4 and derives the levels that correspond to each of the frequency bands on the synthesis side.

On the other hand, in accordance with the instructions of the keyboard 3, the DSP reads out the specified waveforms from the waveform memory 7, divides the waveforms equally into each of the bands, changes the levels based on the formant information for each band following the changes, synthesizes the outputs of each of the bands and outputs this to the D/A converter 9. The processing programs and algorithms are stored in a ROM that is built into the DSP 6. The MPU 2 may also transmit to the RAM of the DSP 6 as required.

These programs are programs that execute the speech signal analysis process, the envelope interpolation and generation process, the modulation process, and the like that are executed by the analysis filter bank 10, the envelope detector and interpolator 11, and the synthesis filter bank 13, which will be discussed later. In addition, the A/D converter 8, which converts the speech signal that has been input into a digital signal, and the D/A converter 9, which converts the musical tone signal that has been modulated into an analog signal, are connected to the DSP 6.

Figure 2:
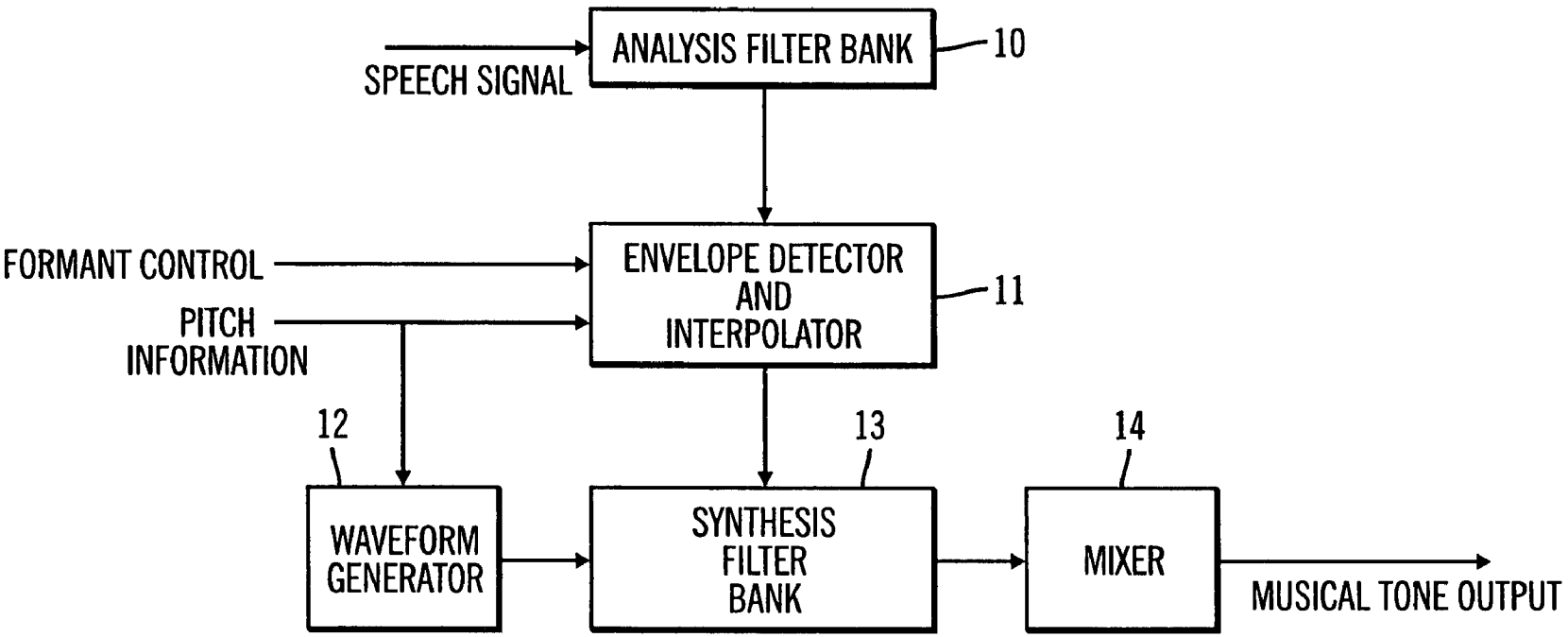
FIG. 2 is a block diagram that shows a theoretical configuration of a vocoder system according to an embodiment of the present invention.

Next, an explanation will be given in detail regarding the processing that is executed by the DSP 6 while referring to FIG. 2 through FIG. 10. FIG. 2 shows an outline of the various processes expressed as a block diagram. The analysis filter bank 10 divides the speech signal that has been input into a plurality of frequency bands and detects the level of each of the frequency bands. The analysis filter bank 10 comprises a plurality of bandpass filters for different frequency bands. Since the auditory characteristics of the frequency domains are logarithmically approximated, each of the frequency bands is set such that they are at equal intervals on a logarithmic axis. Each of the bandpass filters that comprise the analysis filter bank 10 is well-known and comprises, such as is shown in FIG. 5, for example, a plurality of well-known single sample delay devices 15, a plurality of well-known multipliers 16 each having a different coefficient, and a plurality of well-known adders 17. For the speech signal that has been divided into each of the frequency bands, the level that corresponds to each of the bands is derived by means of obtaining the peak value or the RMS value of the waveform.

Figure 10:
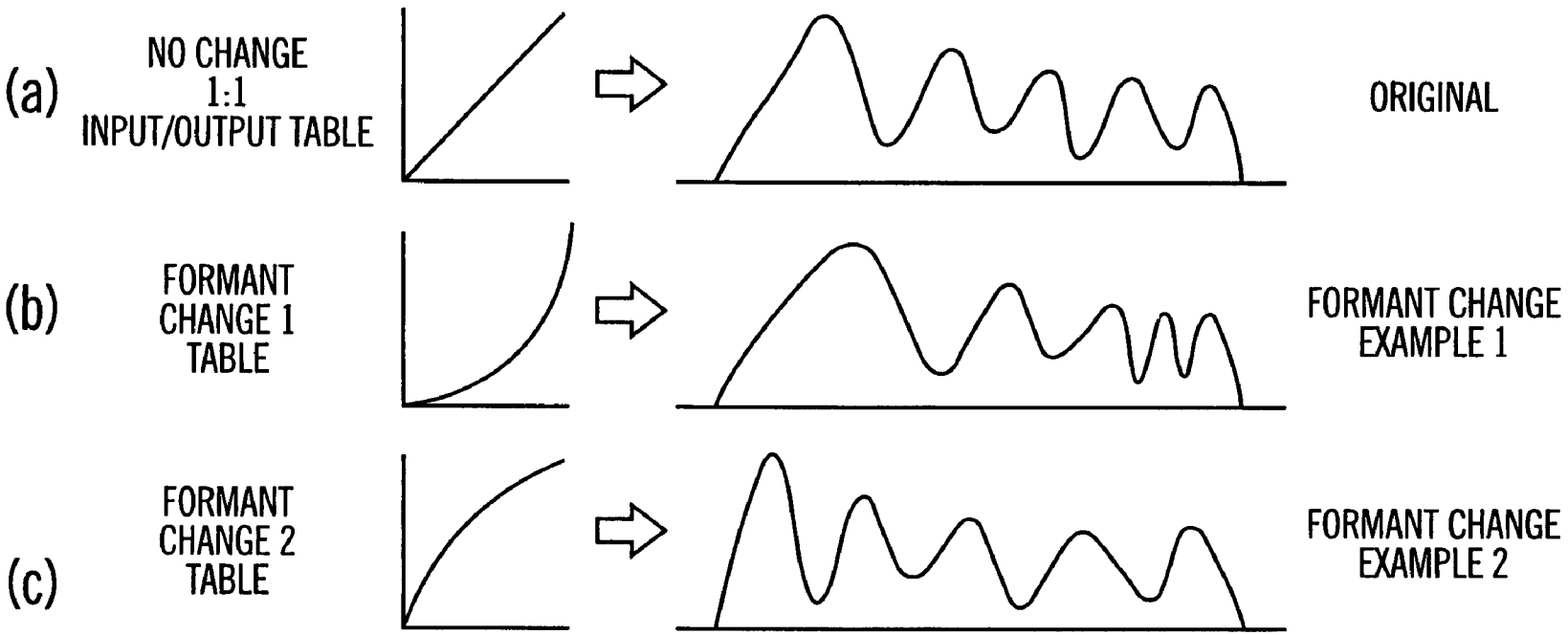
FIGS. 10(*a*) through 10(*c*) show the situation in which the formant curves of the input signals that have been detected are changed into the formant curves shown on the right side in accordance with the tables on the left side according to an embodiment of the present invention.

The envelope detector and interpolator 11 detects the formant curve on the frequency axis for the speech signal in a certain time from the level of each frequency band that has been detected by the analysis filter bank 10 and, together with this, generates a new formant based on the formant control information that changes the formant curve and the pitch information. Here, the formant control information that changes the formant is assigned by a change table such as is shown in FIGS. 10(*b*) and 10(*c*). The information is information that sets the amount of the shift of the formant toward the direction in which the frequency is high or the direction in which the frequency is low and can be selected or set by the performer as desired.

For example, in those cases where the speech that is input is a male voice, presets in order to change to the formants of a female voice and, conversely, in those cases where the speech that is input is a female voice, presets in order to change to the formants of a male voice, are prepared in advance in the change table and may be selected from among them. In addition, the pitch information that is referred to here is the pitch information of the waveform that is produced by the waveform generator 12. The formant curve that is generated is shifted based on the pitch information and the change table is shifted and changed based on the pitch information. The pitch information corresponds to the pitch that is instructed by the keyboard 3 in FIG. 1. The waveform generator 12 produces a musical tone that corresponds to the pitch information, reads out the waveform that has been stored in the waveform memory and, after carrying out the specified processing, outputs to the synthesis filter bank 13.

The synthesis filter bank 13 divides the musical tone signal that has been input into a plurality of frequency bands and, together with this, amplitude modulates the outputs that have been divided into each of the frequency bands based on the new formant information that has been produced by the envelope detector and interpolator 11. The synthesis filter bank 13 comprises a plurality of filters for different frequency bands, and the characteristics of each filter are fixed corresponding to the respective center frequencies for the bands that have been divided.

The mixer 14 is an adder that mixes the outputs from each of the filters of the synthesis filter bank 13. The outputs from each of the filters of the synthesis filter bank 13 are mixed by the mixer 14, and a musical tone signal having the desired formant characteristics is produced. Incidentally, the signal that has been mixed by the mixer 14 is analog converted by the D/A converter 9 and output from an output system such as a speaker and the like.

Also, in addition to those cases in which a single sound musical tone is produced by the waveform generator 12, there are also cases in which a plurality of musical tones are produced. In those cases, the plurality of musical tones are modulated by a single synthesis filter bank 13.

Figure 3:
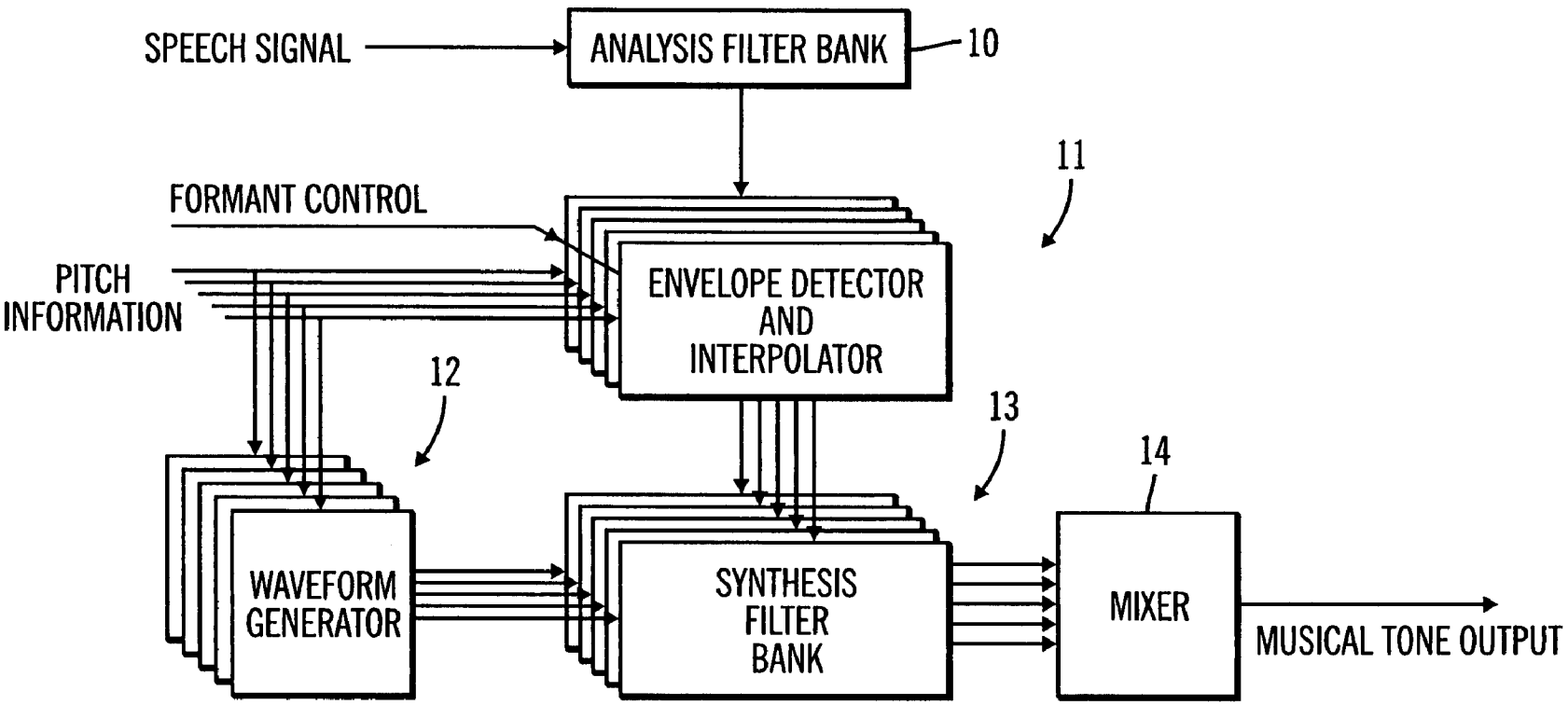
FIG. 3 is a block diagram that shows a theoretical configuration of a vocoder system according to an embodiment of the present invention.

FIG. 3 is a block diagram of the case in which a plurality of keys have been pressed on the keyboard 3 of FIG. 1, a musical tone is produced that corresponds to each of the keys that has been pressed, and different modulations are carried out by the synthesis filter bank 13 for each of the plurality of musical tones. The same number has been assigned to each of the blocks as was assigned to each of the corresponding blocks in FIG. 2. The speech signal that has been input is input to the analysis filter bank 10, and the levels of each of the frequency bands are detected. The processing up to this point is the same as that of FIG. 2. A plurality of envelope detector and interpolators 11 are prepared, and a plurality of items of pitch information that are instructed by the keyboard 3 are input into each. In accordance with each of the items of pitch information, the formants that have been obtained by the analysis filter bank 10 are changed into new formant information. The waveform generator 12 produces musical tones that correspond to the pitch information in accordance with each item of key pressing information and outputs them to the synthesis filter bank 13. In the synthesis filter bank 13, the musical tone signal that has been input is divided into each of the frequency bands, amplitude modulation is carried out in accordance with the formant information that has been newly generated by the corresponding pitch information, and the signal is output to the mixer 14. The outputs of each of the bands of the synthesis filter bank 13 are mixed in the mixer 14 and, in addition, a plurality of musical tones are mixed and output.

Figure 4:
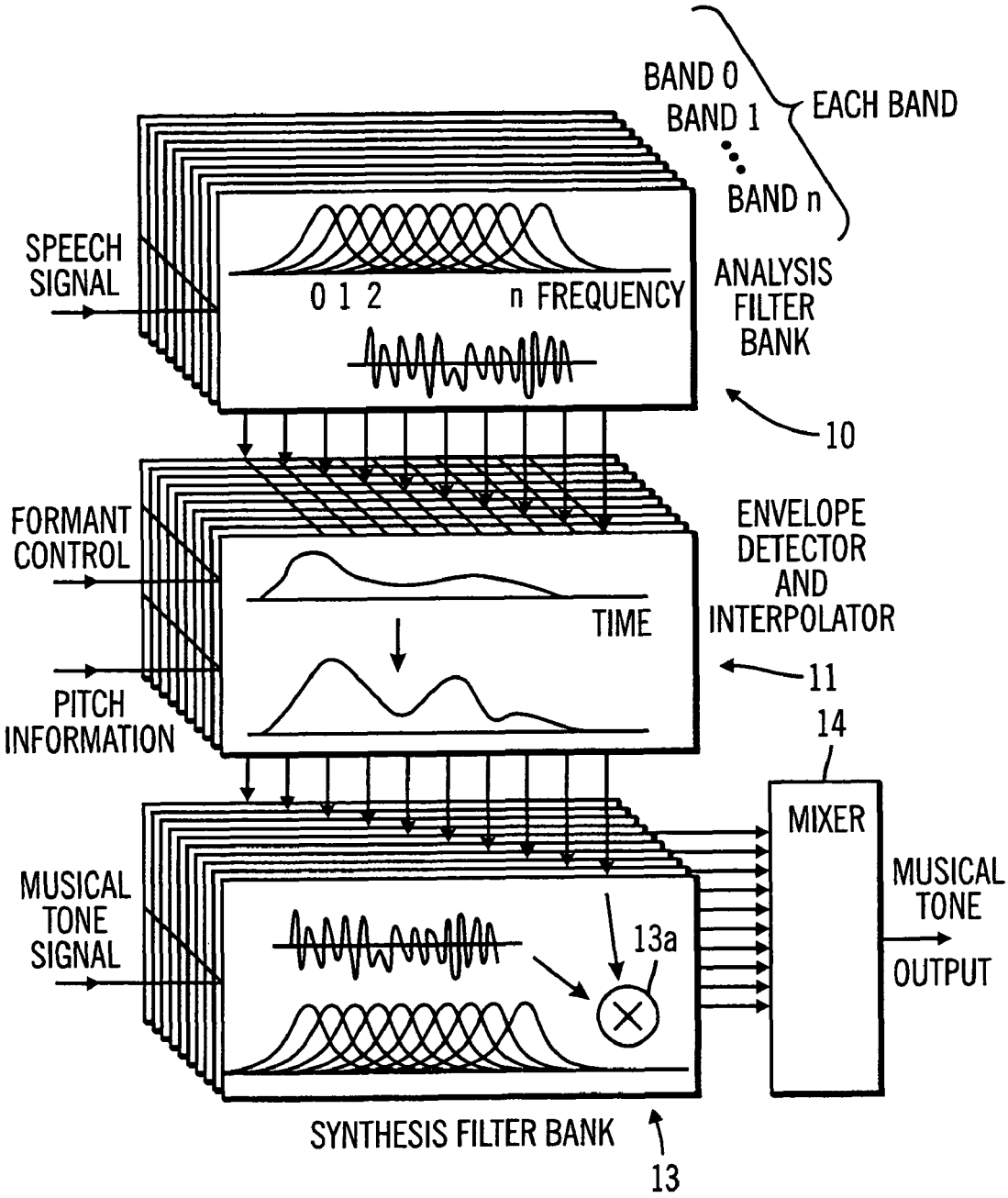
FIG. 4 is a detailed block diagram that shows a theoretical configuration of a vocoder system according to an embodiment of the present invention.
Figure 5:
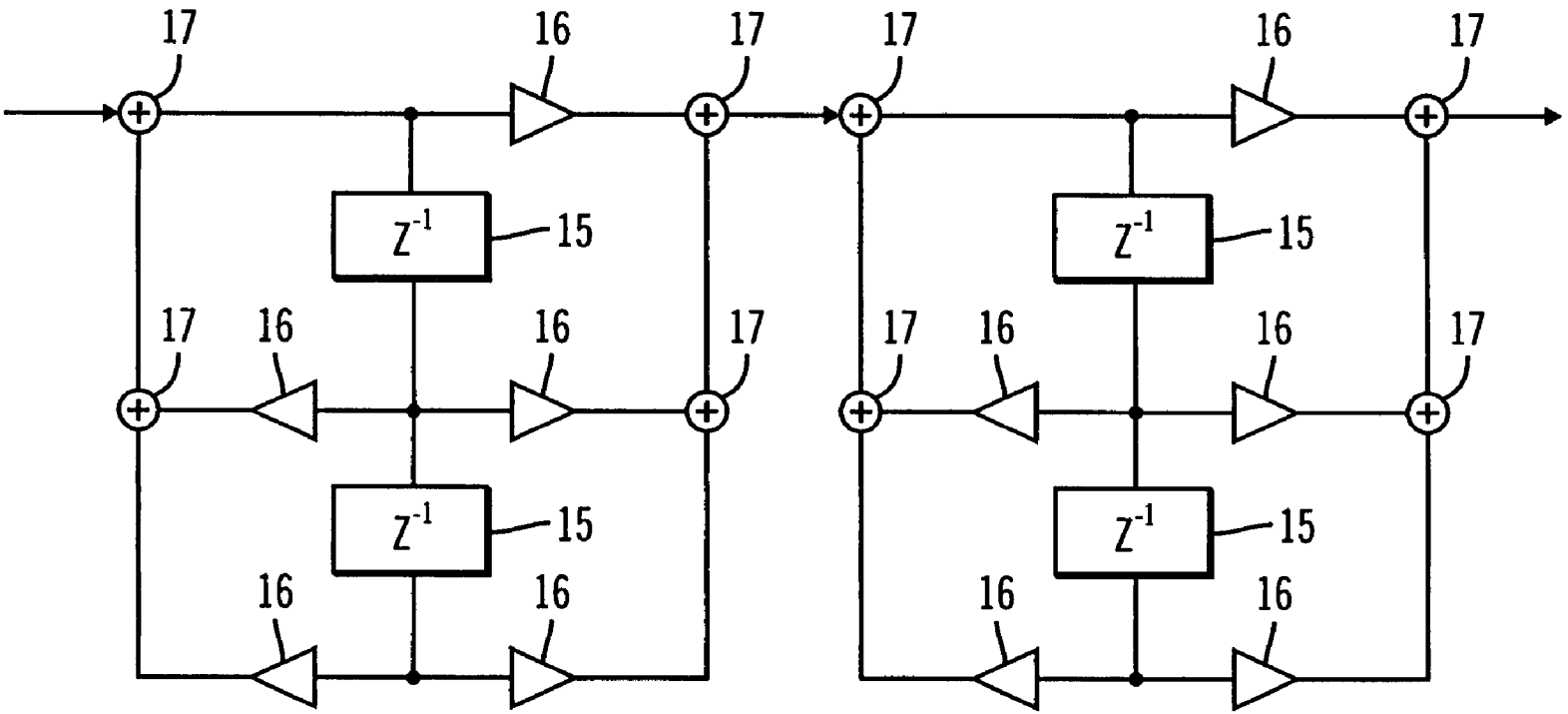
FIG. 5 shows an example of the band pass filter circuits that comprise the analysis filter bank and the synthesis filter bank according to an embodiment of the present invention.

FIG. 4 is a drawing that shows an outline of each of the blocks and waveforms of FIG. 2 and FIG. 3. The diagram of the characteristics on the frequency axis for each of the filters (0 to n) that comprise the analysis filter bank 10 and an example of a speech signal that has passed through the filters are shown in the drawing. The output of each of the filters in the diagram of the characteristics on the frequency axis is the level of the output signal of each of the filters of the analysis filter bank 10. The time axis envelope curve prior to the change and the envelope curve following the change within the envelope detector and interpolator 11 of FIG. 4 are shown in the drawing.

The synthesis filter bank 13 divides the musical tone signal that has been input to a plurality of frequency bands (0 to n;

here the number of analysis filter bank 10 and synthesis filter bank 13 filters has been made the same and each frequency band (center frequency and bandwidth) has also been made the same, but it may also be set up such that they are each different) and, together with this, the outputs that have been divided into each of the frequency bands are amplitude modulated based on the new envelope curve that has been generated by the envelope detector and interpolator 11. The synthesis filter bank 13 comprises a plurality of filters for different frequency bands and the characteristics of each of the filters are fixed corresponding to the respective center frequencies for the bands that have been divided. In addition, each filter is furnished with an amplitude modulator 13*a* with which the output of each corresponding filter is amplitude modulated based on the new envelope curve that has been generated by the envelope detector and interpolator 11.

The mixer 14 is an adder that mixes the outputs from each of the filters of the synthesis bank 13. The outputs from each of the filters of the synthesis filter bank 13 are mixed by the mixer 14 and a musical tone signal having the desired formant characteristics is produced.

Figure 6:
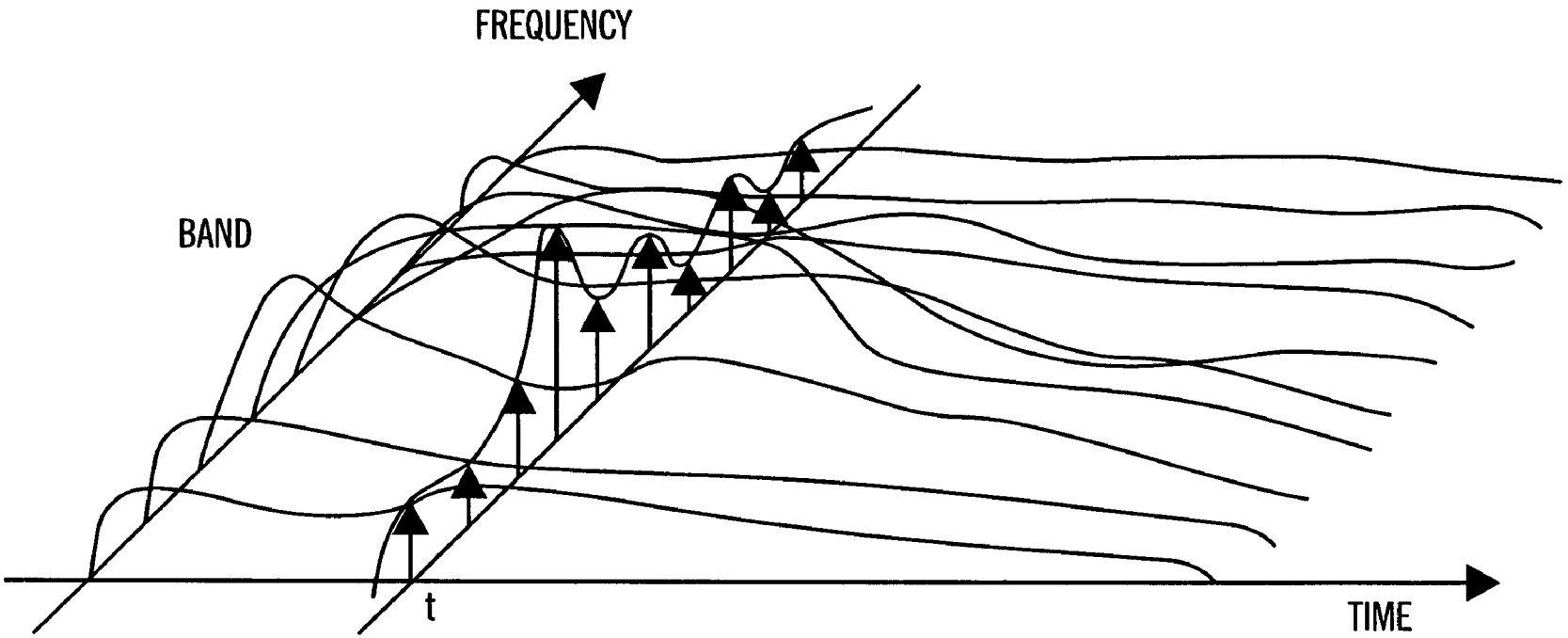
FIG. 6 shows a formant curve that is contoured and produced by the levels of the output signals from each of the filters on the analysis side in a specified time t in three dimensions according to an embodiment of the present invention.

FIG. 6 is a drawing that shows in three dimensions the levels of the output signals from each of the filters of the analysis side for a specified period of time t as contours and the formant curve that is produced as a thick solid line. The horizontal axis indicates time and the axis that is oblique toward the upper right indicates the frequency. The amplitude envelope for each frequency (band) is indicated by the fine lines.

Figure 7:
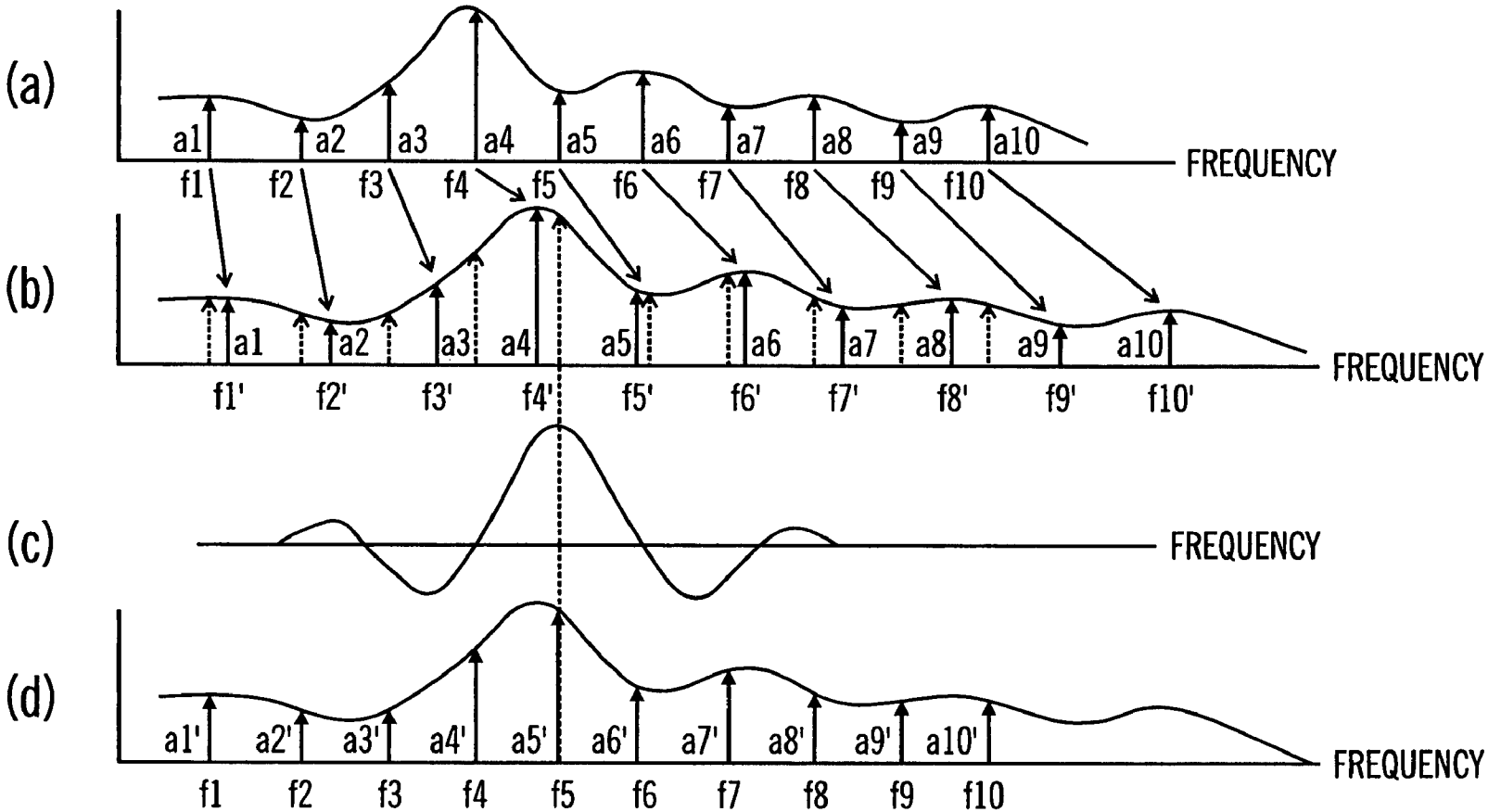
FIG. 7(*a*) shows a formant curve that is contoured and produced by the levels of the output signals from each of the filters in a specified time t in two dimension.

FIG. 7(*a*) is a drawing that shows in two dimensions the levels of the output signals from each of the filters for a specified period of time t as contours and the formant curve that is generated. The level of each frequency f1, f2, . . . is a1, a2, . . . respectively. FIG. 7(*b*) is a drawing that shows the new formant curve in which the formant curve that is shown in FIG. 7(*a*) has been changed based on the pitch information and the formant control information and the relationship between the frequency and the level in those cases where the amplitude modulation is carried out by the methods of the past is shown as a solid line while the method that is implemented by the present invention is shown as a broken line. In other words, with the methods of the past, the level values a1 and a2, which have been obtained for each frequency, are left as they are, unchanged, and each of the frequencies is changed from f1 to f1' and from f2 to f2' (the rest are the same). In contrast to this, with the present invention, the center frequency of each filter of the synthesis filter bank 13 is fixed, and the levels that correspond to those frequencies are derived for the new changed formant curve. FIG. 7(*c*) shows the sinc function that is used for the derivation by interpolation of the level for a specified frequency. This function is one in which a suitable window has been placed on the impulse response (sin X)/X of the ideal low domain FIR filter making it shorter. In this drawing, in order to derive the level a5' that corresponds to the frequency f5 the center of the sinc function is shown as being in agreement with f5. FIG. 7(*d*) is a drawing in which the formant curve has been changed identically to FIG. 7(*b*) and the levels a1', a2', . . . have been derived for each of the frequencies f1, f2, . . . by means of this method.

Next, an explanation will be given of a specific example of the processing that is carried out using the configuration described above. As the first operation example, an explanation will be given regarding the case in which the formant characteristics of the speech signal are expanded and contracted linearly on the frequency axis. When the input signal that has been digitally converted is input to the analysis filter bank 10, the levels of each of the frequency bands (the solid line arrows of FIG. 6 and FIG. 7(*a*)) are detected.

The envelope detector and interpolator 11 contours the levels of each of the frequency bands and produces a formant curve such as that shown in FIG. 6 and FIG. 7(*a*). Together with this, new formant information is generated based on the pitch information and the formant information that changes the formant, the modulation levels that correspond to each of the frequencies of the synthesis filter bank are set by interpolation processing in accordance with the formant information, and the new formant curve that is shown in FIG. 7(*d*) is produced.

With regard to the interpolation processing, the simplest one is the linear interpolation method for the values before and after the derived sample value. However, with this linear interpolation method, since the error becomes large when each band division is economized, the preferable interpolation method is the polynomial arithmetic method using the sinc function in which the interpolation of the time series sample signal is utilized.

This interpolation is processing on the frequency axis and not on the time axis. The item in which the sample value is placed and superimposed on the impulse response shown in FIG. 7(*c*) is interpolated between the sample values.

$$I_i = Y_i \sin\{\pi(X-i)\}/\pi(X-i)$$

Here, $I_i$ indicates the response value in accordance with the sample value $Y_i$ and $Y_i$ indicates the sample value located an amount i from the interpolation point that has been derived. Although the value that has been superimposed is $$Y = \Sigma_{-\infty}^{+\infty} Y_i \sin\{\pi(X-i)\}/\pi(X-i)$$

the length of the impulse response is limited by the window and since i is finite, the calculation amount can be small.

For example, the case in which from the fifth level from the left (the solid line arrow) of FIG. 7(*a*), the impulse response of FIG. 7(*c*) is utilized, and the fifth level from the left (the thick solid line arrow) of FIG. 7(*d*) that corresponds to the fifth level from the left (the dotted line arrow) in FIG. 7(*b*) is derived will be looked at. There is one derivation target shown (the thick sold line arrow a5' of FIG. 7(*d*)) in the middle of the range of the impulse response in FIG. 7(*c*). Six samples are included in the range of the impulse response. Three samples are on the right side of the derivation target interpolation value and three samples are on the left side of the derivation target interpolation value. These six samples are used for a "sum of the products" calculation. If the sum of the products is done for each of the values that correspond to the intervals from theses six sample values to the center of the impulse response, the target interpolation value can be derived. In the same manner, by deriving the other sample values a1' to a10', it is possible to derive the new formant curve in the time t and FIG. 7(*d*).

When it is done in this manner and the new formant curve is produced by the envelope detector and interpolator 11, an amplitude envelope is generated based on the new formant curve and a corresponding musical tone signal output that has been band divided by the synthesis filter bank 13 is amplitude modulated by the amplitude modulator 13*a*. Therefore, the formant characteristics of the output sound are changed from formant characteristics for which the low frequency side is rich to formant characteristics for which the high frequency side is rich. Since it is only necessary to simply modulate the amplitude without the need to change many coefficients in order change the center frequencies of each of the filters that comprise the synthesis filter bank 13 as in the past, it is possible to lighten the computational load of the DSP 6 that carries out the computation.

Figure 8:
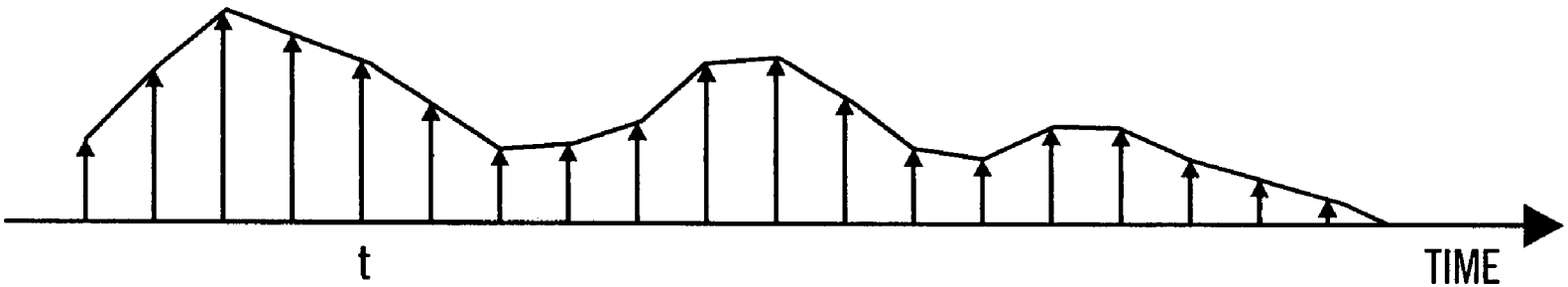
FIG. 8 shows an envelope curve in which linear interpolation of the levels of each specified interval along the time axis of one filter has been done.

In addition, by means of the method discussed above, since the timing at which the modulation level for the modulation of the musical tone signal is produced is not that of the synthesis filter bank 13 that outputs the output sound, there is no need to carry this out for each sample and a comparatively slow signal is fine. Therefore, the timing at which the modulation level is produced may be a period of several milliseconds, and the value between the periods can be derived, as is shown in FIG. 8, by interpolation using a simple linear type or integration. For example, when the sampling frequency is 32 kHz, if the processing with which the center frequency and the bandwidth are changed is done from one minute to the next, processing is needed every 31 microseconds but, by means of the present invention, simple linear interpolation every few milliseconds will suffice. Therefore, it is possible to further lighten the computational load of the DSP 6 that carries out the computations.

Figure 9:
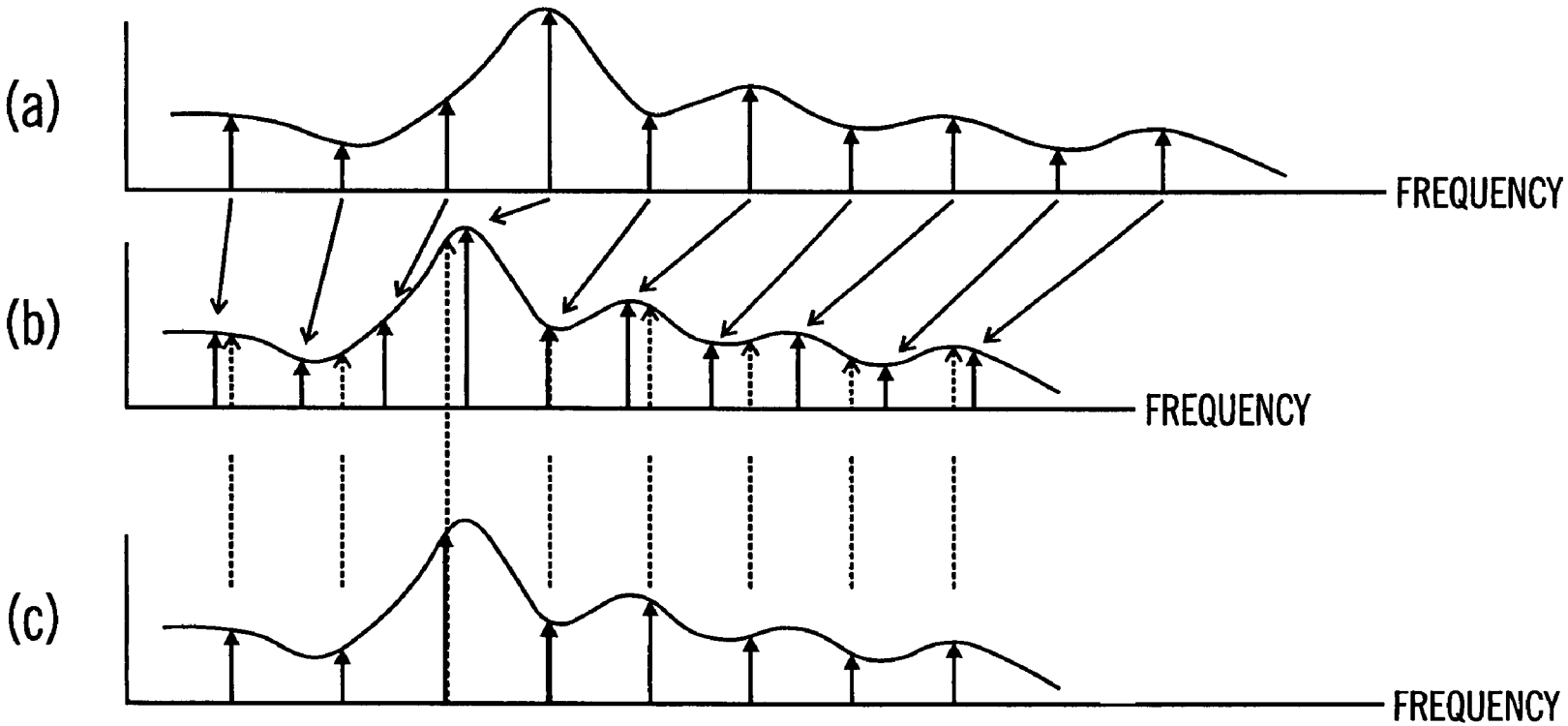
FIG. 9(*a*) shows a formant curve that is contoured and produced by the levels of the output signals from each of the filters in a specified time t in two dimensions.

In FIG. 9, the formant curves that correspond to those of FIGS. 7(*a*), (*b*), and (*d*), are shown in the respective drawings of FIGS. 9(*a*), (*b*), and (*c*) and, here, the original formant is shifted to the low domain side.

Next, an explanation will be given of the second operation example while referring to FIG. 10. In the first operation example, an explanation was given regarding the case in which the formant of the speech signal is expanded and contracted linearly on a logarithmic frequency axis. However, in the second operation example, the explanation is given of the case in which the formant of the speech signal is expanded and contracted non-linearly on a logarithmic frequency axis. FIGS. 10(*a*) through 10(*c*) are drawings that show the situation in which the formant that is detected from the speech signal that has been input is changed in accordance with the tables on the left sides as the formant information with an envelope curve that expresses the formant as shown on the right side.

Although, for a formant change in accordance with sex or age as in the case of a change from a male voice to a female or a child's voice, expansion and contraction is done roughly uniformly on a logarithmic frequency axis, strictly speaking, the sizes of the throats, the palates, and the lips of women and children are different and there are also individual differences. Therefore, even if a male voice is extended linearly on a logarithmic frequency axis, these will be subtle differences with that of a female as well as that of a child and an unnatural impression is imparted.

In addition, there are cases in which it is desired to change the center frequency or bandwidth of the specific band of the formant characteristics and produce a special effect. For example, there are cases in which it is desired to intentionally move the resonant frequency of the formant in order to match the singing pitch. This is called a singing formant. In this case, since it is not possible to obtain the desired output by simply expanding and contracting the formant on a logarithmic frequency axis, it is necessary to expand and contract the formant non-uniformly on the logarithmic frequency axis.

Therefore, the positions of the low domain, the middle domain, and the high domain are changed by non-uniformly distorting the scale of the logarithmic frequency axis, and the expansion and contraction of the formant on the logarithmic frequency axis is done non-uniformly. With regard to the method with which the scale is distorted, there are those such as the one using a specific function and the method using a numeric table and the like. In this preferred embodiment, the formant of the speech signal is changed non-uniformly on the logarithmic frequency axis using the tables shown on the left sides of FIGS. 10(*a*) through 10(*c*).

The envelope detector and interpolator 11 sets the modulation level with which the level of the musical tone signal is modulated based on the level of each frequency band that has been detected by the analysis filter bank 10, the tables that are shown on the left side of FIG. 10 as the formant information with which the formant is changed. The formant curves that express the new formants such as those shown on the right side of FIG. 10 are produced from the formant curves of the speech signal that has been detected by the envelope detector and interpolator 11.

Specifically, with the tables that are shown on the left side of FIG. 10, the input frequency is provided in the Y axis direction and the output frequency is provided in the X axis direction. When the formant curve of the speech signal that has been detected by the envelope detector and interpolator 11 is transformed in accordance with the table that is shown on the left side of FIG. 10(*a*), since the frequency that has been input is output without being changed, the formant curve that is newly produced is, as is shown on the right side of FIG. 10(*a*), not particularly changed.

On the other hand, when the formant curve of the speech signal that has been detected by the envelope detector and interpolator 11 is transformed in accordance with the table that is shown on the left side of FIG. 10(*b*), the input of the low frequency side is enlarged toward the high frequency side and the input of the high frequency side is contracted and output. Therefore, the formant curve of the speech signal is, as is shown on the right side of FIG. 10(*b*), changed so as to be enlarged on the low domain side and contracted on the high domain side. By this means, it is possible to express a tone quality, the low domain side of which is rich.

In addition, when the formant curve of the speech signal that has been detected by the envelope detector and interpolator 11 is transformed in accordance with the table that is shown on the left side of FIG. 10(*c*), the input of the low frequency side is contracted and the input of the high frequency side is enlarged on the high frequency side and output. Therefore, the formant curve of the speech signal is, as is shown on the right side of FIG. 10(*c*), changed so as to be contracted on the low domain side and enlarged on the high domain side. By this means, it is possible to express a tone quality, the high domain side of which is rich.

The new formant curve that is obtained in this manner is a new envelope curve that modulates the levels that correspond to each of the frequency bands that have been divided by the synthesis filter bank 13 are modulated. In addition, in those cases where the vocoder system 1 is made polyphonic, as has been discussed above, when the formant is changed in accordance with each specified pitch information, an envelope detector and interpolator, a synthesis filter bank, and an amplitude modulator must be prepared for each voice. Since the change in accordance with the pitch is gentle, rather than changing the formant in accordance with each of the voices, the formant is changed in accordance with some registers, for example three register groups of high, middle, and low, it is possible to reduce the number of synthesis filter banks and the like.

Explanations were given above of the present invention based on preferred embodiments; however, the present invention is in no way limited to the preferred embodiments that have been discussed above, and the fact that various modifications and changes are possible that do not deviate from and are within the scope of the essentials of the present invention can be easily surmised. For example, a plurality of digital band pass fitters are used as the method with which the formant of the speech that is input is detected but, instead of this, the level for each specified frequency may be detected using Fourier transforms (FFT). In this case, the levels of the fundamental frequencies of the musical tones that have been input and each of their harmonics are derived. Based on the levels of the fundamental wave and the harmonics that have been derived in this way, amplitude modulation of each of the respective components that have been divided by the band pass filters on the synthesis side is possible.

In addition, in the preferred embodiments described above, IIR filters were given as examples of the band pass filters used for analysis and synthesis but FIR filters may also be used. In addition, since the bands for each of the speech signals that have been divided by each band pass filter are limited, resampling may be done at a sampling frequency that corresponds to the band and the count for the performance time is reduced.

In addition, in the preferred embodiments described above, the synthesis filter bank 13 also comprises a plurality of band pass filters and has been divided into the musical tone signal of each frequency band. However, the spectrum waveform may be obtained by the Fourier transforms (FFT) of the musical tone signal, a window for each frequency band is placed on the spectrum waveform and the waveform is divided, a reverse Fourier transform is done for each, and the musical tone signals for each frequency band are synthesized.

In addition, for the vocoder system 1 of these preferred embodiments, an explanation was given regarding the case where specified formant information with which the formant of the speech signal that has been input is changed is applied. However, rather than inputting a speech signal, a speech signal stored in advance, the formant of this speech signal is detected, an envelope signal is produced based on that formant, and the musical tone signal is modulated. In addition, with regard to the musical tone signal, this does not have to be limited to an electronic musical instrument such as a piano and the like, and may also be voices, the cries of animals, and sounds produced by nature.

As another method for changing the formant, there is the method in which the center frequency and bandwidth of each of the filters that comprise the analysis filter bank 10 is changed. Specifically, if the center frequencies and the bandwidths of the analysis filter bank 10 are made a fixed percentage smaller than those of the synthesis filter bank 13, each of the levels of the synthesis filters corresponding to each of the levels obtained by each of the analysis filters are set based on each of the levels obtained by each of the analysis filters. A formant curve such as is shown in FIG. 7(*b*) in which the formant is expanded toward the high frequency side on the logarithmic frequency axis is produced from a speech signal that possesses the formant characteristics shown in FIG. 7(*a*). If the output of the synthesis filter bank 13 is modulated by the envelope curve that has been obtained in this manner, it is possible to shift the formant characteristics of the output sound to the high frequency side. Therefore, it is possible to obtain relatively the sane effect as when the center frequencies of each of the filters that comprise the synthesis filter bank 13 are changed.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A vocoder system comprising:

formant detection means for analyzing a first musical tone signal to detect formant characteristics of the first musical tone signal;

musical tone signal input means for inputting a second musical tone signal that corresponds to specified pitch information;

formant generation means for generating new formant characteristics of the first musical tone signal based on the formant characteristics of the first musical tone signal, formant control information for generating the new formant characteristics from the formant characteristics, and the specified pitch information corresponding to the second musical tone signal;

division means for dividing the second musical tone signal into a plurality of frequency bands, the respective center frequencies of which have been fixed;

setting means for setting modulation levels, based on the new formant characteristics of the first musical tone signal, only at the fixed center frequency of each of the frequency bands of the second musical tone signal; and modulation means for modulating a level of a signal of each of the frequency bands of the second musical tone signal based on the respective modulation level set in the setting means.

2. The vocoder system cited in claim 1, wherein the formant detection means comprises a filter.

3. The vocoder system cited in claim 1, wherein the formant detection means comprises a Fourier transform.

4. The vocoder system cited in claim 1, wherein the division means comprises a filter.

5. The vocoder system cited in claim 2, wherein the division means comprises a filter.

6. The vocoder system cited in claim 3, wherein the division means comprises a filter.

7. The vocoder system cited in claim 1, wherein the division means comprises a Fourier transform.

8. The vocoder system cited in claim 2, wherein the division means comprises a Fourier transform.

9. The vocoder system cited in claim 3, wherein the division means comprises a Fourier transform.

10. The vocoder system cited in claim 1, wherein the setting means sets the modulation levels of the second musical tone signal by interpolation processing based on the new formant characteristics of the first musical tone signal.

11. The vocoder system cited in claim 2, wherein the setting means sets the modulation levels of the second musical tone signal by interpolation processing based on the new formant characteristics of the first musical tone signal.

12. The vocoder system cited in claim 3, wherein the setting means sets the modulation levels of the second musical tone signal by interpolation processing based on the new formant characteristics of the first musical tone signal.

13. The vocoder system cited in claim 4, wherein the setting means sets the modulation levels of the second musical tone signal by interpolation processing based on the new formant characteristics of the first musical tone signal.

14. The vocoder system cited in claim 5, wherein the setting means sets the modulation levels of the second musical tone signal by interpolation processing based on the new formant characteristics of the first musical tone signal.

15. The vocoder system cited in claim 6, wherein the setting means sets the modulation levels of the second musical tone signal by interpolation processing based on the new formant characteristics of the first musical tone signal.

16. The vocoder system cited in claim 7, wherein the setting means sets the modulation levels of the second musical tone signal by interpolation processing based on the new formant characteristics of the first musical tone signal.

17. The vocoder system cited in claim 8, wherein the setting means sets the modulation levels of the second musical tone signal by interpolation processing based on the new formant characteristics of the first musical tone signal.

18. The vocoder system cited in claim 9, wherein the setting means sets the modulation levels of the second musical tone signal by interpolation processing based on the new formant characteristics of the first musical tone signal.

19. The vocoder system cited in claim 1, wherein the setting means sets the modulation levels of the second musical tone signal based on the specified pitch information and the new formant characteristics of the first musical tone signal.

20. The vocoder system cited in claim 2, wherein the setting means sets the modulation levels of the second musical tone signal based on the specified pitch information and the new formant characteristics of the first musical tone signal.

21. The vocoder system cited in claim 3, wherein the setting means sets the modulation levels of the second musical tone signal based on the specified pitch information and the new formant characteristics of the first musical tone signal.

22. The vocoder system cited in claim 4, wherein the setting means sets the modulation levels of the second musical tone signal based on the specified pitch information and the new formant characteristics of the first musical tone signal.

23. The vocoder system cited in claim 5, wherein the setting means sets the modulation levels of the second musical tone signal based on the specified pitch information and the new formant characteristics of the first musical tone signal.

24. The vocoder system cited in claim 6, wherein the setting means sets the modulation levels of the second musical tone signal based on the specified pitch information and the new formant characteristics of the first musical tone signal.

25. The vocoder system cited in claim 7, wherein the setting means sets the modulation levels of the second musical tone signal based on the specified pitch information and the new formant characteristics of the first musical tone signal.

26. The vocoder system cited in claim 8, wherein the setting means sets the modulation levels of the second musical tone signal based on the specified pitch information and the new formant characteristics of the first musical tone signal.

27. The vocoder system cited in claim 9, wherein the setting means sets the modulation levels of the second musical tone signal based on the specified pitch information and the new formant characteristics of the first musical tone signal.

28. The vocoder system cited in claim 1, wherein the setting means stores a formant change table that changes the formant non-uniformly and sets the modulation levels that correspond to each of the frequency bands based on the change table.

29. The vocoder system cited in claim 2, wherein the setting means stores a formant change table that changes the formant non-uniformly and sets the modulation levels that correspond to each of the frequency bands based on the change table.

30. The vocoder system cited in claim 3, wherein the setting means stores a formant change table that changes the formant non-uniformly and sets the modulation levels that correspond to each of the frequency bands based on the change table.

31. The vocoder system cited in claim 4, wherein the setting means stores a formant change table that changes the formant non-uniformly and sets the modulation levels that correspond to each of the frequency bands based on the change table.

32. The vocoder system cited in claim 5, wherein the setting means stores a formant change table that changes the formant non-uniformly and sets the modulation levels that correspond to each of the frequency bands based on the change table.

33. The vocoder system cited in claim 6, wherein the setting means stores a formant change table that changes the formant non-uniformly and sets the modulation levels that correspond to each of the frequency bands based on the change table.

34. The vocoder system cited in claim 7, wherein the setting means stores a formant change table that changes the formant non-uniformly and sets the modulation levels that correspond to each of the frequency bands based on the change table.

35. The vocoder system cited in claim 8, wherein the setting means stores a formant change table that changes the formant non-uniformly and sets the modulation levels that correspond to each of the frequency bands based on the change table.

36. The vocoder system cited in claim 9, wherein the setting means stores a formant change table that changes the formant non-uniformly and sets the modulation levels that correspond to each of the frequency bands based on the change table.

37. The vocoder system cited in claim 1, wherein the first musical tone signal is produced by a male voice or a female voice.

38. The vocoder system cited in claim 1, wherein the level of the signal of each of the frequency bands modulated by the modulation means is an amplitude of the signal.

39. The vocoder system cited in claim 1, wherein, in the modulation means, the center frequencies of the frequency bands are maintained as fixed in the division means.

40. The vocoder system cited in claim 10, wherein the setting means sets the modulation levels by using a polynomial interpolation.

41. The vocoder system cited in claim 1, wherein the center frequencies of the modulated signals of the frequency bands are equal to the respective center frequencies of the frequency bands, as fixed by the division means.

42. The vocoder system cited in claim 1, wherein the first musical tone signal is a speech signal.

43. The vocoder system cited in claim 10, wherein the setting means sets the modulation level at the fixed center frequency of at least one of the frequency bands by interpolation processing based on the formant characteristics at a plurality of frequencies.

44. The vocoder system cited in claim 40, wherein the setting means sets the modulation level at the fixed center frequency of at least one of the frequency bands by using a polynomial interpolation of the formant characteristics at a plurality of frequencies.

45. The vocoder system cited in claim 4, wherein the filter comprises a digital filter having frequency characteristics defined by a plurality of filter coefficients, and wherein the setting means sets the modulation levels, free of changing the filter coefficients.

46. The vocoder system cited in claim 4, wherein the filter comprises a digital filter having frequency characteristics defined by a plurality of filter coefficients, and wherein the setting means sets the modulation levels while the filter coefficients remain constant.

47. The vocoder system cited in claim 1, further comprising:

first signal division means for dividing the first musical tone signal into a plurality of frequency bands, the respective center frequencies of which have been fixed;

a level detection means for detecting a level of each of the frequency bands of the first musical tone signal;

the formant detection means for detecting the formant characteristics of the first musical tone signal based on the detected levels of each of the frequency bands of the first musical tone signal.

48. A method for generating a musical signal with a computer system comprising a detector, an input device, a frequency divider, and a processor, the method comprising:

analyzing a first musical tone signal with the detector to detect formant characteristics of the first musical tone signal;

inputting a second musical tone signal into the input device that corresponds to specified pitch information;

generating new formant characteristics of the first musical tone signal based on the formant characteristics of the first musical tone signal, formant control information for generating the new formant characteristics from the formant characteristics, and the specified pitch information corresponding to the second musical tone signal;

dividing the second musical tone signal with the frequency divider into a plurality of frequency bands, the respective center frequencies of which have been fixed;

setting modulation levels with the processor, based on the new formant characteristics of the first musical tone signal, only at the fixed center frequency of each of the frequency bands of the second musical tone signal; and modulating with the processor a level of a signal of each of the frequency bands of the second musical tone signal based on the respective modulation level.

49. A vocoder system comprising:

a formant detector for analyzing a first musical tone signal to detect formant characteristics of the first musical tone signal;

an input device for inputting a second musical tone signal that corresponds to specified pitch information;

a formant generator for generating new formant characteristics of the first musical tone signal based on the formant characteristics of the first musical tone signal, formant control information for generating the new formant characteristics from the formant characteristics, and the specified pitch information corresponding to the second musical tone signal;

a divider connected to the input device for dividing the second musical tone signal into a plurality of frequency bands, the respective center frequencies of which have been fixed;

a level setter for setting modulation levels, based on the new formant characteristics of the first musical tone signal, only at the fixed center frequency of each of the frequency bands of the second musical tone signal; and a modulator for modulating a level of a signal of each of the frequency bands of the second musical tone signal based on the respective modulation level set in the level setter.

50. The vocoder system cited in claim 49, wherein the formant detector comprises a filter.

51. The vocoder system cited in claim 49, wherein the formant detector comprises a Fourier transform.

52. A vocoder system comprising:

formant detection means for analyzing a first musical tone signal to detect formant characteristics of the first musical tone signal;

musical tone signal input means for inputting a second musical tone signal that corresponds to specified pitch information;

formant generation means for generating new formant characteristics of the first musical tone signal based on the formant characteristics of the first musical tone signal, formant control information for generating the new formant characteristics from the formant characteristics, and the specified pitch information corresponding to the second musical tone signal;

filtering means for dividing the second musical tone signal into a plurality of frequency bands based on respective fixed center frequencies;

setting means for setting modulation levels, based on the new formant characteristics of the first musical tone signal, only at the fixed center frequency of each of the frequency bands of the second musical tone signal; and modulation means for modulating a level of a signal of each of the frequency bands of the second musical tone signal based on the respective modulation level set in the setting means.

* * * * *